US011805872B2

(12) United States Patent
Plakotaris et al.

(10) Patent No.: US 11,805,872 B2
(45) Date of Patent: Nov. 7, 2023

(54) SPORTS MOUTHGUARD CARRY CASE

(71) Applicant: DR MARK'S HYGENIE PTY LTD, Wagga Wagga (AU)

(72) Inventors: Stephen Plakotaris, Leichhardt (AU); Mark Wotherspoon, Wagga Wagga (AU)

(73) Assignee: DR MARK'S HYGENIE PTY LTD, New South Wales (AU)

( * ) Notice: Subject to any disclaimer, the term of this patent is extended or adjusted under 35 U.S.C. 154(b) by 47 days.

(21) Appl. No.: 17/595,878

(22) PCT Filed: Jun. 10, 2020

(86) PCT No.: PCT/AU2020/050584
§ 371 (c)(1),
(2) Date: Nov. 29, 2021

(87) PCT Pub. No.: WO2021/000006
PCT Pub. Date: Jan. 7, 2021

(65) Prior Publication Data

US 2022/0225744 A1 Jul. 21, 2022

(30) Foreign Application Priority Data

Jul. 1, 2019 (AU) ..... 2019902321

(51) Int. Cl.
*A45C 11/00* (2006.01)
*A45C 13/02* (2006.01)
(Continued)

(52) U.S. Cl.
CPC ..... *A45C 11/00* (2013.01); *A45C 13/02* (2013.01); *B65D 11/10* (2013.01); *B65D 25/108* (2013.01);
(Continued)

(58) Field of Classification Search
CPC ..... A45C 11/00; A45C 13/02; A45C 11/008; A45C 13/002; A45C 2011/007;
(Continued)

(56) References Cited

U.S. PATENT DOCUMENTS 2,163,862 A * 6/1939 Wing ..... A61C 17/036 206/83
4,966,319 A * 10/1990 Fleming ..... A45C 11/00 206/83
(Continued)

FOREIGN PATENT DOCUMENTS

DE 203 18 762 6/2004
EP 2 653 054 10/2013
(Continued)

OTHER PUBLICATIONS

International-type Search for Provisional Patent Application issued in Australian Patent Application No. 2019902321, dated Aug. 14, 2019, 6 pages.
(Continued)

*Primary Examiner* — Rafael A Ortiz
(74) *Attorney, Agent, or Firm* — Hamre, Schumann, Mueller & Larson, P.C.

(57) ABSTRACT

A mouthguard carry case (10) comprising: an outer shell (12) having a hollow interior defined by an open top, an open bottom and a plurality of side walls (14). The mouthguard carry case (10) also comprises an inner shell (18) having a hollow interior defined by a top wall (20), a bottom wall (22) and plurality of side walls (24). The inner shell (18) is slidably received within the hollow interior of the outer shell (12) and is movable between an open position, and a closed position. Advantageously the mouthguard carry case (10) can be opened and closed in one hand, and is fully ventilated to promote drying and inhibit the growth of oral bacteria.

14 Claims, 9 Drawing Sheets

(51) Int. Cl.

| | |
|---|---|
| ***B65D 25/10*** | (2006.01) |
| ***B65D 81/26*** | (2006.01) |
| ***A63B 71/08*** | (2006.01) |
| ***B65D 6/00*** | (2006.01) |

(52) U.S. Cl.
CPC ..... *B65D 81/263* (2013.01); *A45C 2011/007* (2013.01); *A63B 71/085* (2013.01)

(58) Field of Classification Search
CPC .... B65D 11/10; B65D 81/263; B65D 52/108; B65D 11/12; B65D 15/16; A63B 71/085
USPC .... 206/63.5, 581, 38, 83, 579, 368, 823, 37, 206/758, 361, 369, 6.1, 210, 91, 96, 528; 220/8, 913, 23.87, 544
See application file for complete search history.

(56) References Cited

U.S. PATENT DOCUMENTS

| | | | | |
|---|---|---|---|---|
| 6,705,333 | B1 * | 3/2004 | Pourcho | A45D 44/20 134/201 |
| 8,579,137 | B2 * | 11/2013 | Lustenberger | B65D 83/0061 206/828 |
| 10,772,714 | B1 * | 9/2020 | Chapman | H04W 4/029 |
| 2004/0244805 | A1 | 12/2004 | Cook et al. | |
| 2008/0179201 | A1 * | 7/2008 | Hess | A61C 19/10 206/83 |
| 2008/0283422 | A1 * | 11/2008 | Jansheski | B65D 43/164 206/63.5 |
| 2009/0152134 | A1 * | 6/2009 | Katsis | B65D 5/38 206/96 |
| 2015/0144510 | A1 * | 5/2015 | Hamdoun | B65D 7/10 206/63.5 |
| 2018/0071420 | A1 * | 3/2018 | Bestel | A61L 2/26 |

FOREIGN PATENT DOCUMENTS

| | | | | |
|---|---|---|---|---|
| EP | 2653054 | A1 * | 10/2013 | A45C 11/00 |
| KR | 10-2020-0025202 | | 3/2020 | |

OTHER PUBLICATIONS

International Search Report issued in International Application No. PCT/AU2020/050584, dated Aug. 17, 2020, 5 pages.
Written Opinion issued in International Application No. PCT/AU2020/050584, dated Aug. 17, 2020, 4 pages.
Plastic Medical Kit Portable Three Grid Medicine Box Storage Boxes AU—eBay [retrieved from Internet on Aug. 14, 2020] <URL :https://www.ebay.com.au/itm/Plastic-Medical-Kit-Portable-Three-Grid-Medicine-Box-Storage-Boxes-AU/154027797902?hash=item23dcc5ad8e:g:jlYAAOSwgM5e4etx> (The International Searching Authority is unable to establish the publication date of the above citation).
Genmine Denture Bath Box Case with Strainer Dental Orthodontic Retainer False Teeth Storage Case Box with Lid Mouth Guard Soaking Container [retrieved from internet on Aug. 14, 2020] <URL: https://qatar.desertcart.com/products/47022552-genmine-denture-bath-box-case-with-strainer-dental-orthodontic-retainer-false-teeth-storage-case-box-with-lid-mouth-guard-soaking-container-drain-tray-night-gum-shield-travel-storage-case-holder> (The International Searching Authority is unable to establish the publication date of the above citation).

* cited by examiner

SPORTS MOUTHGUARD CARRY CASE

FIELD OF THE INVENTION

The present invention relates to a mouthguard carry case, and relates more particularly to a sports accessary for improved oral hygiene in the form of a sports mouthguard storage and carry case.

BACKGROUND TO THE INVENTION

There are a large number of prior art sports mouthguard storage and carry case products available in the worldwide market for sports accessories. Most are simple, moulded plastic products, with a single-hinged flip-top lid, that require two hands to open. Most are only slightly ventilated or unventilated, and are typically airtight units that do not promote mouthguard drying or sanitation. A wet mouthguard placed into an airtight or poorly ventilated storage case, where it will not dry, is very susceptible to the spread of oral bacteria that collects on the mouthguard when in use.

The present invention was developed with a view to providing an improved sports mouthguard carry case that can be easily opened and closed with one hand. Advantageously the improved sports mouthguard carry case is also well ventilated so as to permit the mouthguard to dry more quickly, hence stifling the spread of oral bacteria and promoting oral hygiene.

References to prior art in this specification are provided for illustrative purposes only and are not to be taken as an admission that such prior art is part of the common general knowledge in Australia or elsewhere.

SUMMARY OF THE INVENTION

According to one aspect of the present invention there is provided a mouthguard carry case comprising:

an outer shell having a hollow interior defined by an open top, an open bottom and a plurality of side walls;

an inner shell having a hollow interior defined by a top wall, a bottom wall and a plurality of side walls, the inner shell being slidably received within the hollow interior of the outer shell and being movable between an open position in which a mouthguard can be placed inside the hollow interior of the inner shell, and a closed position in which the inner shell is substantially received within the hollow interior of the outer shell.

Preferably the outer shell is of substantially rectangular configuration, and the inner shell is likewise of substantially rectangular configuration so as to be received within the outer shell with a friction fit. Advantageously the hollow interior of the inner shell forms an inbuilt mouthguard cradle for the mouthguard. So rather than hinging open from one side of the carry case, as in most prior art carry cases, the inner shell can be popped upwards out of the outer shell while being held in one hand, exposing the mouthguard cradle.

Preferably at least one portion of a side wall of the inner shell is ventilated to permit the flow of air and other fluids into and out of the carry case. Preferably both the inner and outer shells are ventilated to the maximum allowable to ensure strength and durability. Typically the ventilated portion of the side wall of the inner shell is provided with plurality of ventilation apertures arranged in a rectangular array.

In an illustrated embodiment the outer shell comprises four substantially planar side walls of substantially equal length, with rounded protrusions at each corner to facilitate a better grip in one hand.

Preferably the inner shell comprises a substantially U-shaped open portion in the top wall and a matching substantially U-shaped open portion in the bottom wall, wherein both open portions open to one side of the substantially rectangular inner shell. Preferably the top wall and bottom wall of the inner shell are of substantially planar configuration. Preferably the inner shell is formed with an interior side wall of substantially U-shaped configuration extending around, and connecting, the U-shaped open portions of the top and bottom walls. Preferably the other three sides of the substantially rectangular inner shell are substantially open so as to provide easy access to the mouthguard cradle, within which a mouthguard can be received when the inner shell is in the open position. Preferably two sides of the inner shell, adjacent to, and on either side respectively of, the interior side wall, are formed with a partial side wall so as to form together with the interior side wall the mouthguard cradle within the inner shell. In the illustrated embodiment the interior side wall is formed by five substantially planar wall segments, wherein a central wall segment of the interior side wall is provided with the plurality of ventilation apertures arranged in a rectangular array.

Advantageously the central wall segment faces an open ventilation space formed on the one side of the inner shell between the interior side wall and a first side wall of the outer shell. The height of the first side wall is of reduced dimensions relative to the other three side walls, which further enhances the free flow of air and other fluids through the ventilation apertures in the central wall segment.

Throughout the specification, unless the context requires otherwise, the word "comprise" or variations such as "comprises" or "comprising", will be understood to imply the inclusion of a stated integer or group of integers but not the exclusion of any other integer or group of integers. Likewise the word "preferably" or variations such as "preferred", will be understood to imply that a stated integer or group of integers is desirable but not essential to the working of the invention.

BRIEF DESCRIPTION OF THE DRAWINGS

The nature of the invention will be better understood from the following detailed description of a specific embodiment of a sports mouthguard carry case, given by way of example only, with reference to the accompanying drawings, in which.

DETAILED DESCRIPTION OF PREFERRED EMBODIMENTS

A preferred embodiment of a sports mouthguard carry case 10 in accordance with the invention, as illustrated in FIGS. 1 to 12, comprises an outer shell 12 having a hollow interior defined by an open top, an open bottom and a plurality of side walls 14. In this embodiment the outer shell 12 is of substantially rectangular configuration and comprises four substantially planar side walls 14 of substantially equal length, with rounded protrusions 16 at each corner to facilitate a better grip in one hand.

Figure 1:
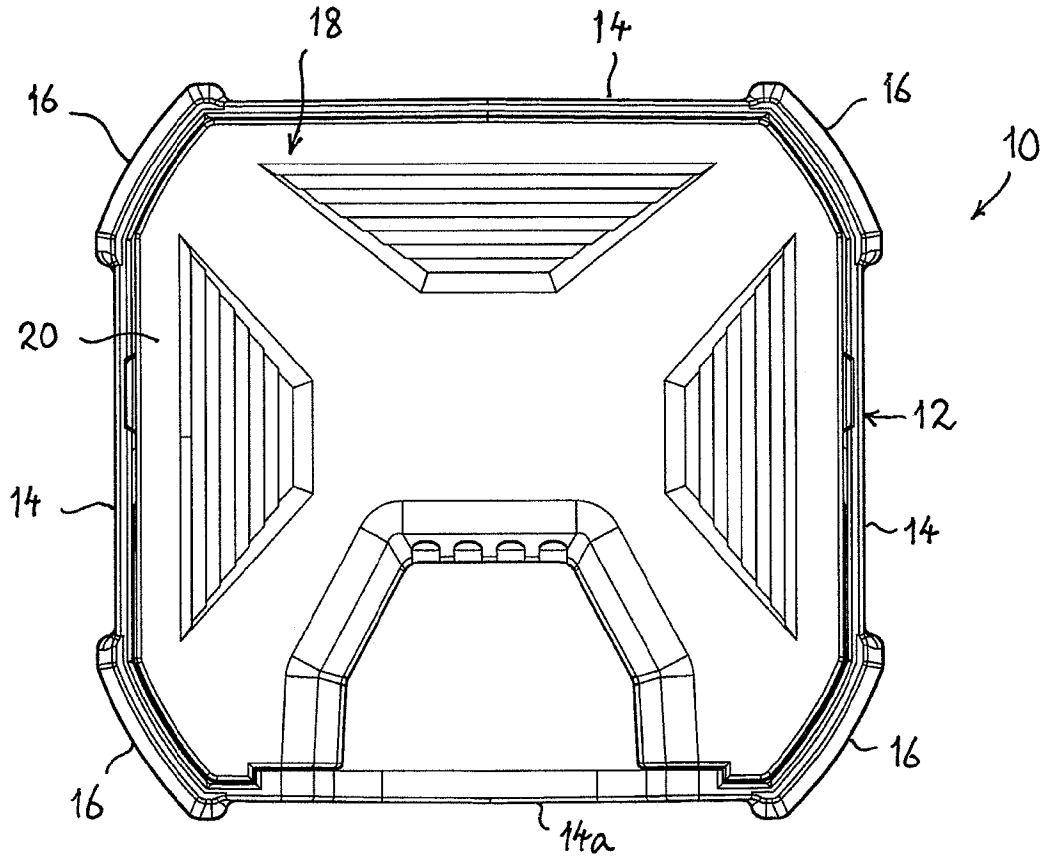
FIG. 1 is top plan view of a preferred embodiment of a sports mouthguard carry case according to the present invention.
Figure 2:
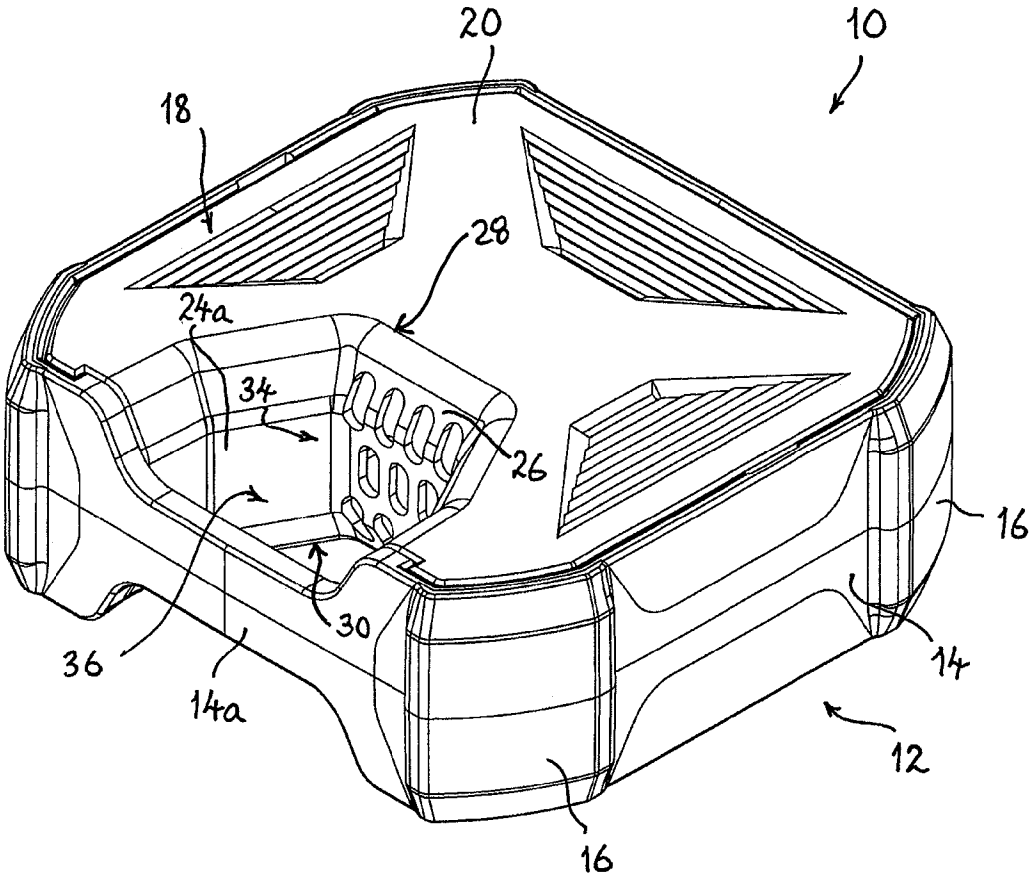
FIG. 2 is a top perspective view of the sports mouthguard carry case of FIG. 1 with the inner shell in a closed position.
Figure 3:
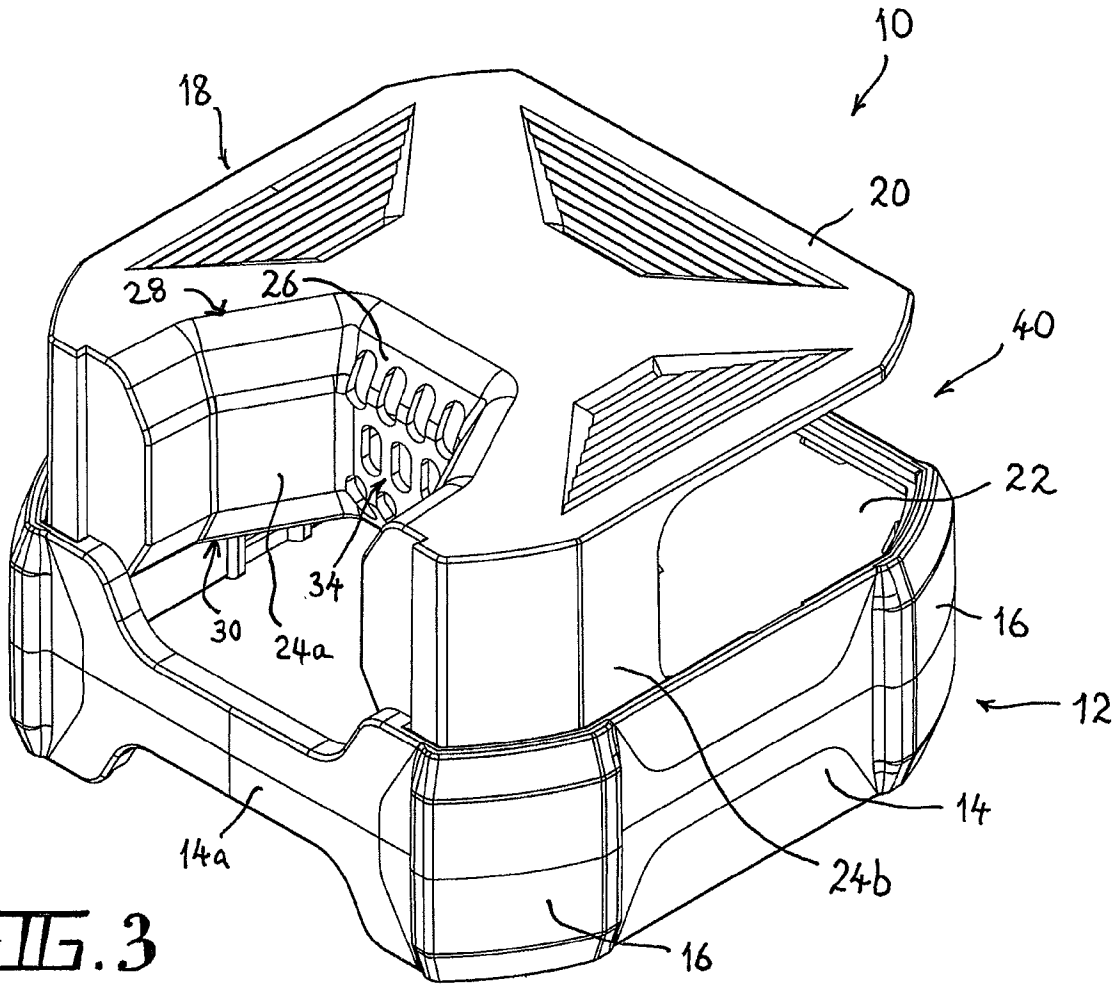
FIG. 3 is a top perspective view of the sports mouthguard carry case of FIG. 1 with the inner shell in an open position.
Figure 4:
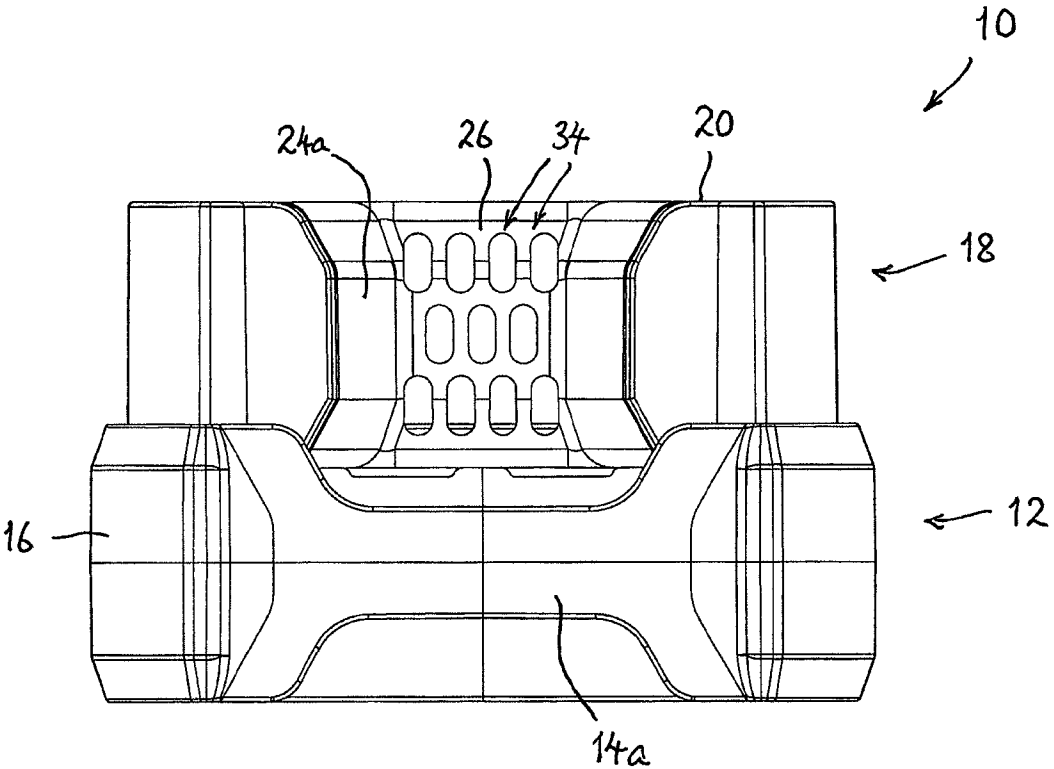
FIG. 4 is a front elevation of the sports mouthguard carry case of FIG. 3 with the inner shell in an open position.

The mouthguard carry case 10 further comprises an inner shell 18 having a hollow interior defined by a top wall 20, a bottom wall 22 and plurality of side walls 24. The inner shell 18 is slidably received within the hollow interior of the outer shell 12 and is movable between an open position, as shown in FIG. 2, in which a mouthguard 50 can be placed inside the hollow interior of the inner shell 18, and a closed position, as shown in FIG. 3, in which the inner shell is substantially received within the hollow interior of the outer shell (see also FIGS. 9 to 12).

Preferably the inner shell 18 is similarly of substantially rectangular configuration so as to be received within the outer shell 12 with a friction fit. Advantageously the hollow interior of the inner shell 18 forms an inbuilt mouthguard cradle 40 for the mouthguard. So rather than hinging open from one side of the carry case, as in most prior art carry cases, the inner shell 18 can be popped upwards out of the outer shell 12 while being held in one hand, exposing the mouthguard cradle 40.

Preferably at least one portion of a side wall 24 of the inner shell 18 is ventilated to permit the flow of air and other fluids into and out of the carry case 10. Preferably both the inner and outer shells are ventilated to the maximum allowable to ensure strength and durability.

The improved sports mouthguard carry case 10 was developed as a more hygienic and simple to use carrier than is typically available. The mouthguard carry case 10 comprises a fully ventilated design so each surface of a sports mouthguard is subject to air flow when stored. Improved air flow allows for a sports mouthguard 50 (see FIGS. 9 to 12) to dry more quickly hence stifling the spread of oral bacteria that is collected on the mouthguard when in use. Enhanced ventilation also allows for the mouthguard 50 to be treated with any type of sanitising protocol and replaced immediately into the mouthguard carry case 10, where it is (again) well ventilated and will dry quickly, as opposed to a wet mouthguard being placed into an airtight or poorly ventilated storage case where it will not dry, consequently exposed to additional hygiene risks.

Preferably the inner shell 18 comprises a substantially U-shaped open portion 28 in the top wall 20 and a matching substantially U-shaped open portion 30 in the bottom wall 22, wherein both open portions 28, 30 open to one side of the substantially rectangular inner shell 18. In this embodiment the top wall 20 and bottom wall 22 of the inner shell 18 are of substantially planar configuration. Preferably the inner shell 18 is formed with an interior side wall 24*a* of substantially U-shaped configuration extending around, and connecting, the U-shaped open portions 28, 30 of the top and bottom walls.

Figure 5:
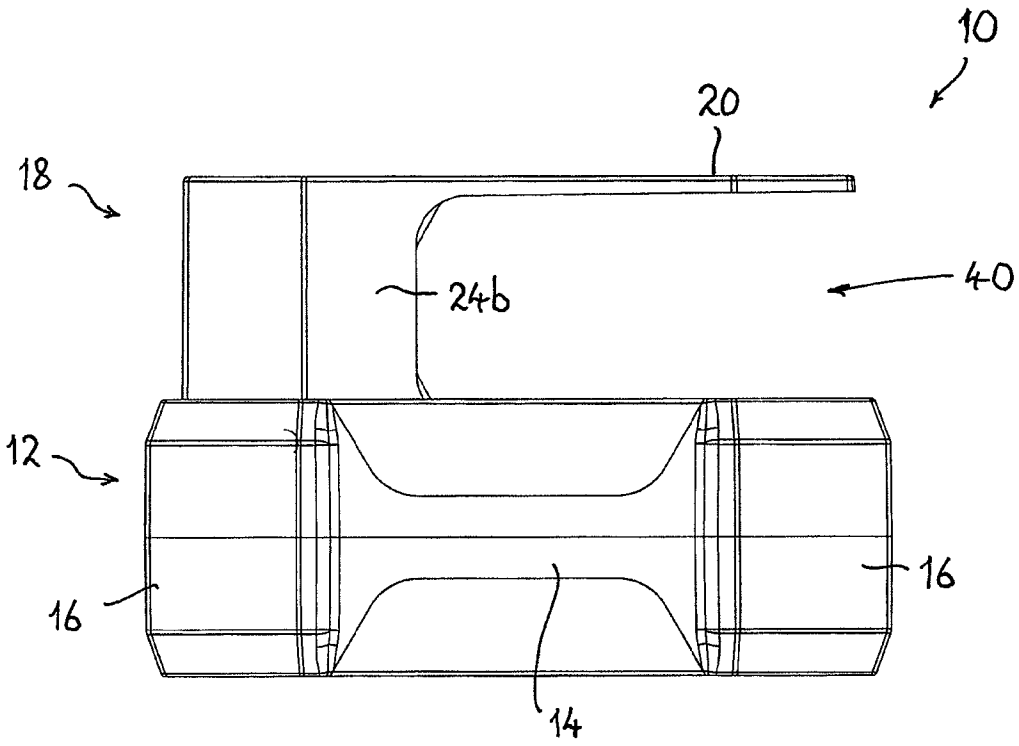
FIG. 5 is a side elevation of the sports mouthguard carry case of FIG. 3 with the inner shell in an open position.
Figure 6:
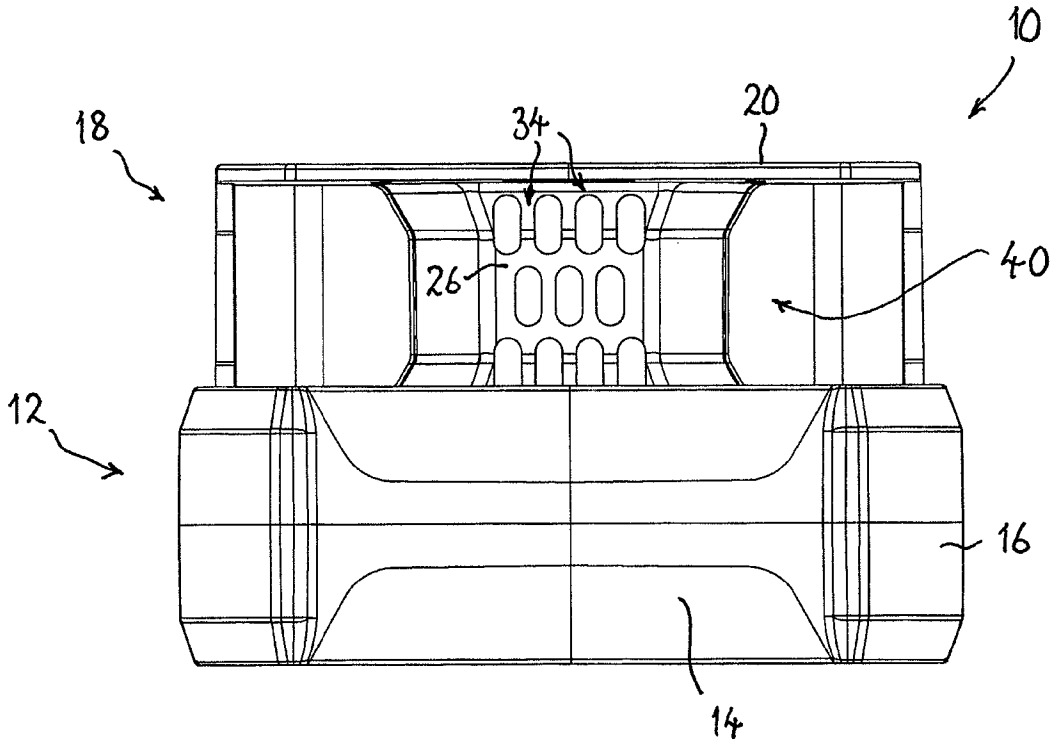
FIG. 6 is a rear elevation of the sports mouthguard carry case of FIG. 3 with the inner shell in an open position.
Figure 7:
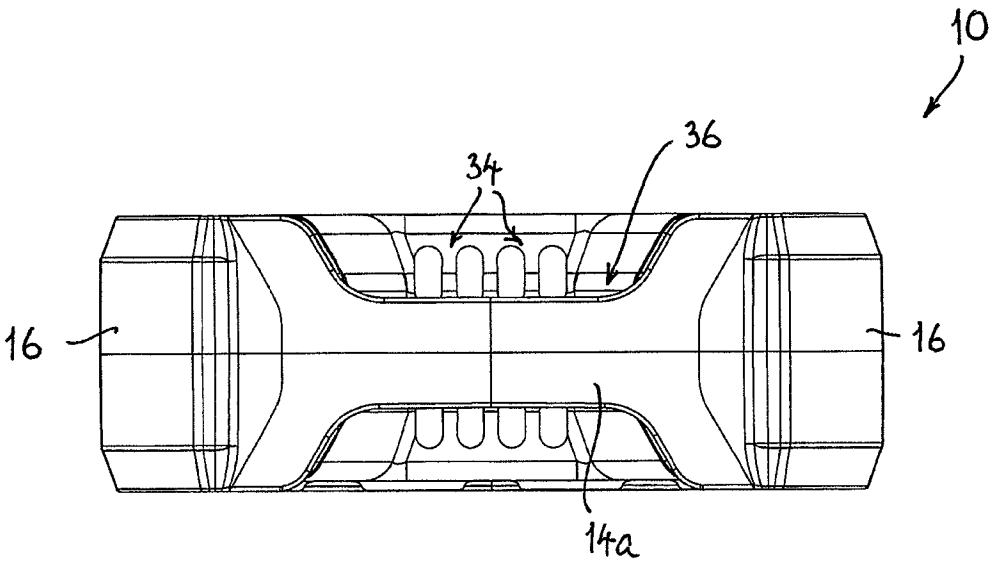
FIG. 7 is a front elevation of the sports mouthguard carry case of FIG. 2 with the inner shell in a closed position.
Figure 8:
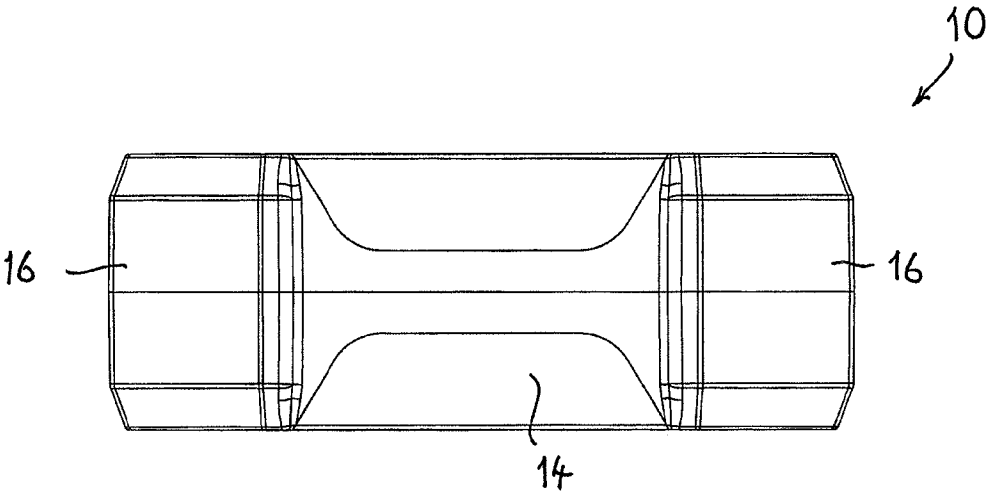
FIG. 8 is a rear elevation of the sports mouthguard carry case of FIG. 2 with the inner shell in a closed position.
Figure 11:
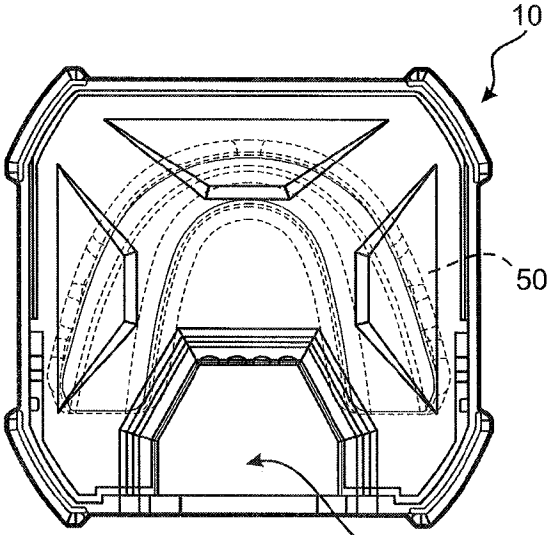
FIG. 11 is top plan transparent view of the sports mouthguard carry case of FIG. 2, with the inner shell in a closed position, showing a mouthguard positioned in the inner shell; and, FIG. 12 is section view of the sports mouthguard carry case of FIG. 2, with the inner shell in a closed position, showing a mouthguard positioned in the inner shell.
Figure 12:
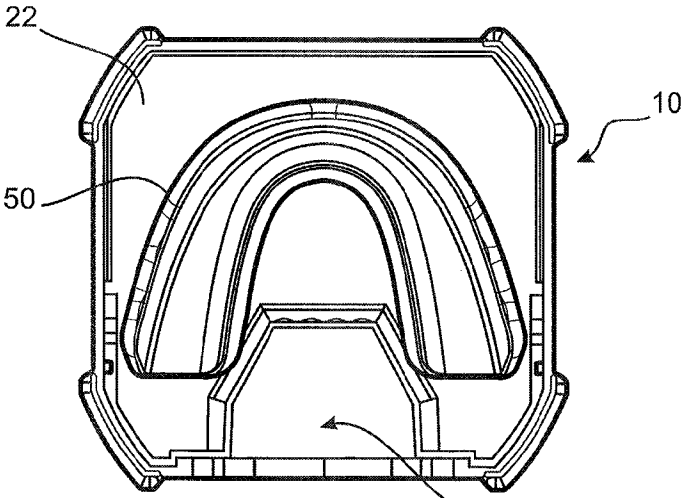
Figure 9:
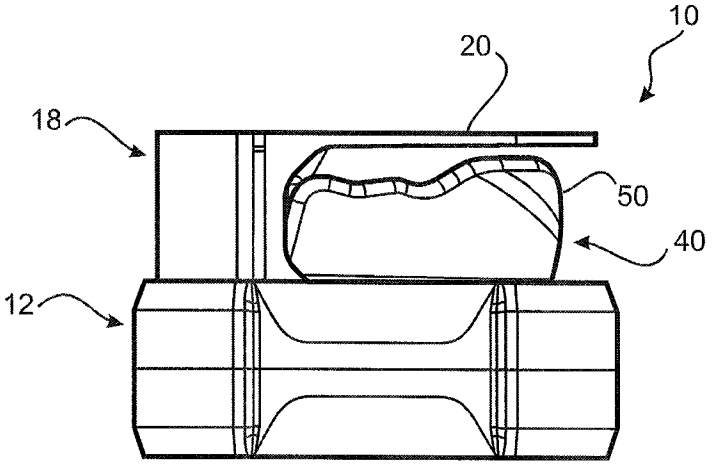
FIG. 9 is a side elevation of the sports mouthguard carry case of FIG. 3 with the inner shell in an open position showing a mouthguard received in the inner shell.
Figure 10:
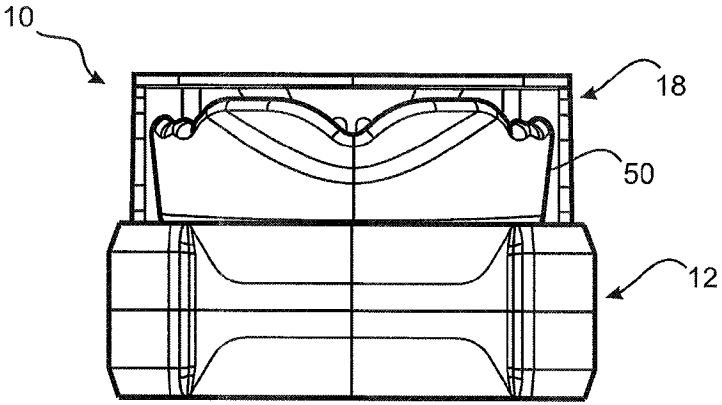
FIG. 10 is a rear elevation of the sports mouthguard carry case of FIG. 3, with the inner shell in an open position, showing a mouthguard positioned in the inner shell.

Preferably the other three sides of the substantially rectangular inner shell 18 are substantially open so as to provide easy access to the mouthguard cradle 40, within which a mouthguard 50 can be received when the inner shell is in the open position (see FIGS. 3 and 5). Preferably two sides of the inner shell 18, adjacent to, and on either side respectively of, the interior side wall 24*a*, are formed with a partial side wall 24*b* so as to form together with the interior side wall 24*a* the mouthguard cradle 40 within the inner shell 18. In the illustrated embodiment the interior side wall 24*a* is formed by five substantially planar wall segments, wherein a central wall segment 26 of the interior side wall 24*a* is provided with the plurality of ventilation apertures 34 arranged in a rectangular array.

The central wall segment 26 faces an open ventilation space 36 formed on the one side of the inner shell 18 between the interior side wall 24*a* and a side wall 14*a* of the outer shell 12. The height of the side wall 14 is of reduced dimensions relative to the other three side walls 14, which further enhances the free flow of air and other fluids through the ventilation apertures 34 in the central wall segment 26.

Preferably the outer shell 12 and inner shell 18 are both manufactured from a suitable rigid or semi-rigid moulded plastics material, such as a polyethylene or polycarbonate, which may be transparent or opaque.

Now that a preferred embodiment of the mouthguard carry case has been described in detail, it will be apparent that the described embodiment provides a number of advantages over the prior art, including the following:

(i) It can be operated with one hand rather than two, making for safer, simpler function and ease of use.

(ii) It has a fully ventilated design so that each surface of a sports mouthguard is subject to air flow when stored.

It will be readily apparent to persons skilled in the relevant arts that various modifications and improvements may be made to the foregoing embodiments, in addition to those already described, without departing from the basic inventive concepts of the present invention. For example, in the illustrated embodiment the outer shell and inner shell are of substantially rectangular configuration. However this is not essential to the invention, and is more of a design feature to give the improved sports mouthguard carry case a more rugged aesthetic. The case may be of any suitable shape and configuration. Therefore, it will be appreciated that the scope of the invention is not limited to the specific embodiment described.

The invention claimed is:

1. A mouthguard carry case comprising:

an outer shell having a hollow interior defined by an open top, an open bottom and a plurality of side walls;

an inner shell having a hollow interior defined by a top wall, a bottom wall and a plurality of side walls, the inner shell being slidably received within the hollow interior of the outer shell and being movable between an open position in which a mouthguard can be placed inside the hollow interior of the inner shell, and a closed position in which the inner shell is substantially received within the hollow interior of the outer shell, wherein at least one portion of a side wall of the inner shell is ventilated to permit the flow of air and other fluids into and out of the carry case; and wherein both the inner and outer shells are ventilated to the maximum allowable to ensure strength and durability.

2. A mouthguard carry case as defined in claim 1, wherein the outer shell is of substantially rectangular configuration, and the inner shell is likewise of substantially rectangular configuration so as to be received within the outer shell with a friction fit.

3. A mouthguard carry case as defined in claim 1, wherein the hollow interior of the inner shell forms an inbuilt mouthguard cradle for the mouthguard.

4. A mouthguard carry case as defined in claim 3, wherein the inner shell can be popped upwards out of the outer shell while being held in one hand, exposing the mouthguard cradle.

5. A mouthguard carry case as defined in claim 1, wherein the ventilated portion of the side wall of the inner shell is provided with plurality of ventilation apertures arranged in a rectangular array.

6. A mouthguard carry case comprising:

an outer shell having a hollow interior defined by an open top, an open bottom and a plurality of side walls;

an inner shell having a hollow interior defined by a top wall, a bottom wall and a plurality of side walls, the inner shell being slidably received within the hollow interior of the outer shell and being movable between an open position in which a mouthguard can be placed inside the hollow interior of the inner shell, and a closed position in which the inner shell is substantially received within the hollow interior of the outer shell;

wherein the outer shell is of substantially rectangular configuration, and the inner shell is likewise of substantially rectangular configuration so as to be received within the outer shell with a friction fit; and wherein the outer shell comprises four substantially planar side walls of substantially equal length, with rounded protrusions at each corner to facilitate a better grip in one hand.

7. A mouthguard carry case comprising:

an outer shell having a hollow interior defined by an open top, an open bottom and a plurality of side walls;

an inner shell having a hollow interior defined by a top wall, a bottom wall and a plurality of side walls, the inner shell being slidably received within the hollow interior of the outer shell and being movable between an open position in which a mouthguard can be placed inside the hollow interior of the inner shell, and a closed position in which the inner shell is substantially received within the hollow interior of the outer shell;

wherein the hollow interior of the inner shell forms an inbuilt mouthguard cradle for the mouthguard;

wherein the inner shell comprises a substantially U-shaped open portion in the top wall and a matching substantially U-shaped open portion in the bottom wall, wherein both open portions open to one side of the substantially rectangular inner shell.

8. A mouthguard carry case as defined in claim 7, wherein the top wall and bottom wall of the inner shell are of substantially planar configuration.

9. A mouthguard carry case as defined in claim 8, wherein the inner shell is formed with an interior side wall of substantially U-shaped configuration extending around, and connecting, the U-shaped open portions of the top and bottom walls.

10. A mouthguard carry case as defined in claim 9, wherein the other three sides of the substantially rectangular inner shell are substantially open so as to provide easy access to the mouthguard cradle, within which a mouthguard can be received when the inner shell is in the open position.

11. A mouthguard carry case as defined in claim 10, wherein two sides of the inner shell, adjacent to, and on either side respectively of, the interior side wall, are formed with a partial side wall so as to form together with the interior side wall the mouthguard cradle within the inner shell.

12. A mouthguard carry case as defined in claim 9, wherein the interior side wall is formed by five substantially planar wall segments, wherein a central wall segment of the interior side wall is provided with the plurality of ventilation apertures arranged in a rectangular array.

13. A mouthguard carry case as defined in claim 12, wherein the central wall segment faces an open ventilation space formed on the one side of the inner shell between the interior side wall and a first side wall of the outer shell.

14. A mouthguard carry case as defined in claim 13, wherein the height of the first side wall is of reduced dimensions relative to the other three side walls, which further enhances the free flow of air and other fluids through the ventilation apertures in the central wall segment.

* * * * *